United States Patent [19]

DeCorso et al.

[11] 3,938,326

[45] Feb. 17, 1976

[54] CATALYTIC COMBUSTOR HAVING A VARIABLE TEMPERATURE PROFILE

[75] Inventors: Serafino M. DeCorso, Media; Clifford E. Seglem, Wallingford, both of Pa.

[73] Assignee: Westinghouse Electric Corporation, Pittsburgh, Pa.

[22] Filed: June 25, 1974

[21] Appl. No.: 482,911

[52] U.S. Cl. ..... 60/39.74 R; 60/39.82 C; 261/96; 261/116

[51] Int. Cl.[2] ..... F02C 7/22

[58] Field of Search ..... 60/39.69, 39.71, 39.74 R, 60/39.82 C; 431/7; 261/94, 96, 116

[56] References Cited

UNITED STATES PATENTS

| | | | |
|---|---|---|---|
| 2,635,426 | 4/1953 | Meschino | 60/39.71 |
| 3,153,323 | 10/1964 | Hamm | 60/39.71 |
| 3,846,979 | 11/1974 | Pfefferle | 60/39.65 |

FOREIGN PATENTS OR APPLICATIONS

| | | | |
|---|---|---|---|
| 1,932,881 | 8/1970 | Germany | 60/39.74 |

*Primary Examiner*—C. J. Husar
*Assistant Examiner*—Robert E. Garrett
*Attorney, Agent, or Firm*—F. A. Winans

[57] ABSTRACT

A catalytic combustor has an array of fuel injectors and air inductor elements, upstream of a catalytic member in the combustor. Each fuel injector and air inductor arrangement is associated with a discrete passageway confining the air/fuel mixture to a portion of and the catalytic member wherein the combustion of the mixture is initiated. Each fuel injector and air inductor arrangement is provided with controls to vary the fuel and air flowing into each passageway, respectively. This permits the variation of combustion intensity within the catalytic element, which in turn permits a regulatable temperature profile at the exit end of the combustor.

4 Claims, 3 Drawing Figures

CATALYTIC COMBUSTOR HAVING A VARIABLE TEMPERATURE PROFILE

BACKGROUND OF THE INVENTION

1. Field of the Invention

This invention relates generally to combustors, and, more particularly, to catalytic combustors for gas turbine power plants.

2. Description of the Prior Art

Blades in high temperature turbines normally must be cooled internally to withstand the operating temperatures of the turbine. This is because a high motive fluid temperature is necessary for the high efficiency, and the blades may fail due to the high stresses developed within them if not properly cooled. With such internal blade cooling the root area of each blade will not necessarily be at a temperature lower than the remainder of the blade even though the root area is the most highly stressed area of each blade. The life of the blade root is considerably less than that of the remainder of the blade. It is therefore desirable to control the motive fluid temperature profile so that the midsection of the blade generally is exposed to the peak temperature of the hot motive fluid while the root portion is exposed to a much cooler motive fluid which is emanating from the combustor.

Dilution air is ordinarily injected into combustors through an array of orifices in the combustor shell, to yield a desirable motive fluid or an air temperature distribution at the combustor outlet. The combustor air is often diluted to reduce NOx contents of the combustion products and to reduce smoke. Environmental requirements make it mandatory that visible smoke be eliminated and that harmful products of combustion be minimal. This is accomplished by insuring complete combustion, and regulating temperatures and dilution air or injected steam in the combustor. Prior art that exemplify attempts at these goals are U.S. Pat. Nos. 3,498,055; 3,593,518; 3,742,706; and 3,747,336.

SUMMARY OF THE INVENTION

This invention comprises a combustion chamber for a gas turbine wherein the combustion chamber includes a catalytic combustion element. Upstream of the catalytic element there is disposed an array of fuel injectors and air inductors. Each fuel injector has an air induction arrangement disposed about it. Each fuel injector and air inductor is regulatable with respect to themselves and to the remainder of the fuel injectors and air inductors in the array and associated with a discrete passageway disposed between the fuel-air injectors and the catalytic combustor element. This prevents intermixing of different fuel-air ratios ejected from the fuel air arrangements, and permits regulation of the combustion output and the temperature profile of the catalytic combustion element, and hence regulation and control of the combustion output and temperature profile of the combustion chamber itself. The combustion and temperature profile regulatable combustion chamber provides for longer life span of the blades of the turbine and decreased environmental harm.

BRIEF DESCRIPTION OF THE DRAWINGS

The invention, along with the objects and advantages thereof, will be best understood from the following detailed descriptions taken in connection with the accompanying drawings in which.

DESCRIPTION OF THE PREFERRED EMBODIMENT

Figure 1:
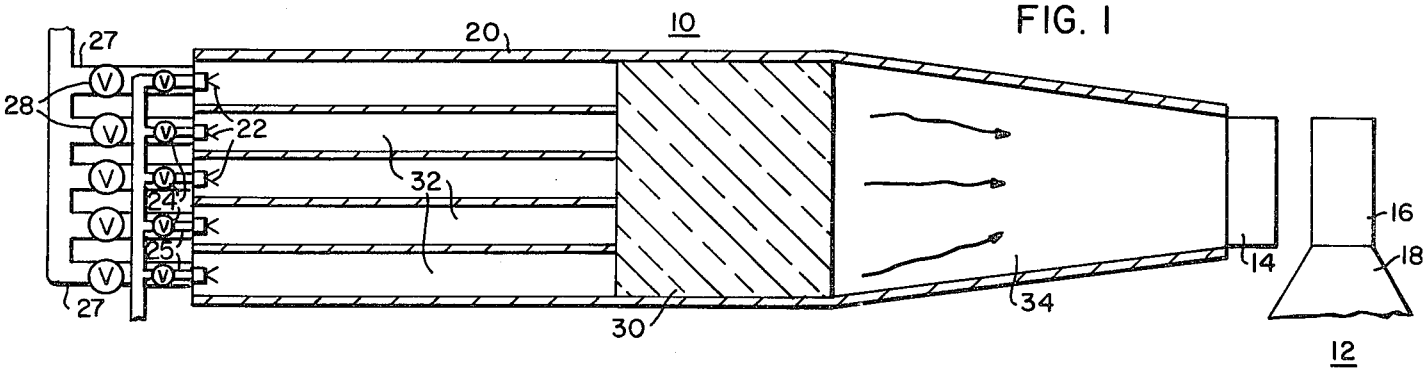
FIG. 1 is a longitudinal sectional view of a combustor constructed in accordance with the principles of the present invention.

Referring now to the drawings in detail, and particularly to FIG. 1, there is shown therein in a longitudinal sectional view of a combustion chamber 10, used in this example, for providing hot motive fluid to a gas turbine, only a portion of a first stage 12 of the turbine, being shown. The first stage 12, being comprised of an annular array of stationary inlet guide vanes 14, and an array of rotatable blades 16, mounted on a rotor disc 18.

In a gas turbine, hot motive fluid, the product of combusted compressed air and fuel, flows out of the downstream end of each combustion chamber 10, an annular array of which is generally used, but only one being shown for this example, in FIG. 1. The combustion products, the hot motive fluid is directed by the inlet guide vanes 14 to strike the rotary blades 16 thereby inducing rotation of the rotor 18 which turns a shaft, not shown, that produces rotary power. The hot motive fluid is passed through additional stages in its hot motive fluid flow path before being ducted out an exhaust annulus, not shown.

Still referring to FIG. 1, the combustion chamber 10, shown therein, is comprised of a generally cylindrically-shaped shell 20. Disposed on the upstream end of the combustor shell 20 is an array of fuel injection members 22. The fuel injected into each fuel injector member 22 is regulated by a fuel control valve 24 on each fuel supply line 25. Disposed about each fuel injection member 22 is an air inductor member 27. Each air inductor member 27 has a flow control valve 28 associated therewith to regulate the flow of the compressed air or gas which is supplied into the combustion process of the combustor 10 from a compressor, not shown.

Each fuel injector member 22 and air inductor member 27 is upstream from a catalytic combustion element 30 disposed within the combustor shell. Between the catalytic combustion element 30 and the fuel and air elements 22 and 27, there is disposed a plurality of generally axially extending channels or discrete passageways 32 which duct the compressed air and jetted fuel mix, from the fuel and air elements, 22 and 27, to the area where the combustion is initiated in the catalytic combustor element 30. After combustion of the fuel-air mix in the catalytic combustor element 30, the product thereof, the hot motive fluid, passes through the downstream end of the combustor 10, called a transition member 34. The transition member 34 is of generally circular cross-section at its upstream end, and it gradually transforms to a generally oval cross-section at its downstream end where it forms, with other combustor exit orifices, a generally annularly arranged hot motive fluid flow passageway, supplying the annularly disposed inlet guide vanes 14, with hot motive fluid.

Each flow regulatable fuel-air arrangement, 22 and 27, has its own discrete channels or passageways 32 confining the air/fuel mixture associated with each to a portion of the catalytic element 30 to permit selective or controllable combustion therein and hence selectable or controllable motive temperatures produced within the catalytic combustor member 30.

By this process, the temperature profile of the hot motive fluid reaching the inlet vanes 14 and the rotating blades 16 can be closely controlled to reduce high temperature motive fluid from reducing the work life and functionability of the inlet vanes and blades 14 and 16. The temperature profile of the motive fluid as it envelops the rotating blades 16 is particularly important, since the excessive heat may detrimentally effect the radially inner end of the blade adjacent the root 16, and cause failure therein due to that area being under the highest stress.

Figure 2:
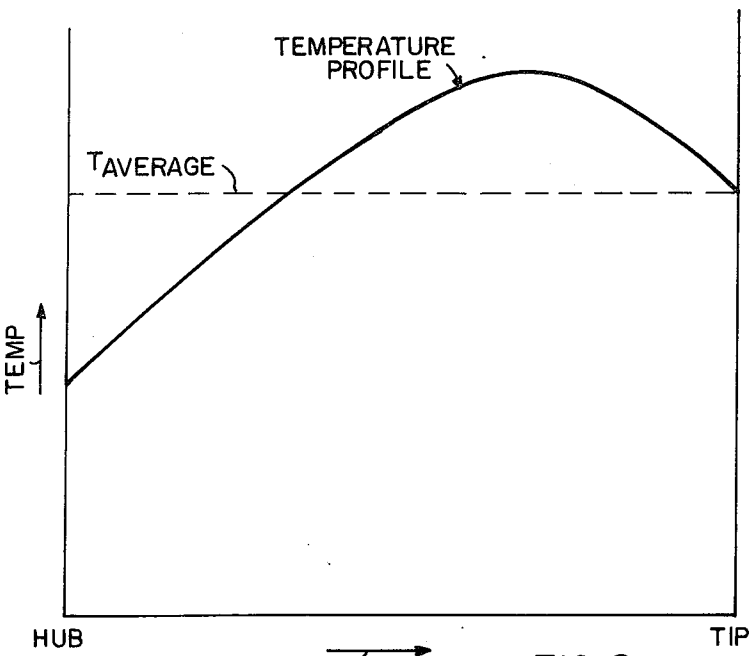
FIG. 2 is a graphical representation of a temperature profile for a gas turbine blade; and, FIG. 3 is a graphical representation of a temperature profile and its relationship to combustion chamber fuel-air elements.
Figure 3:
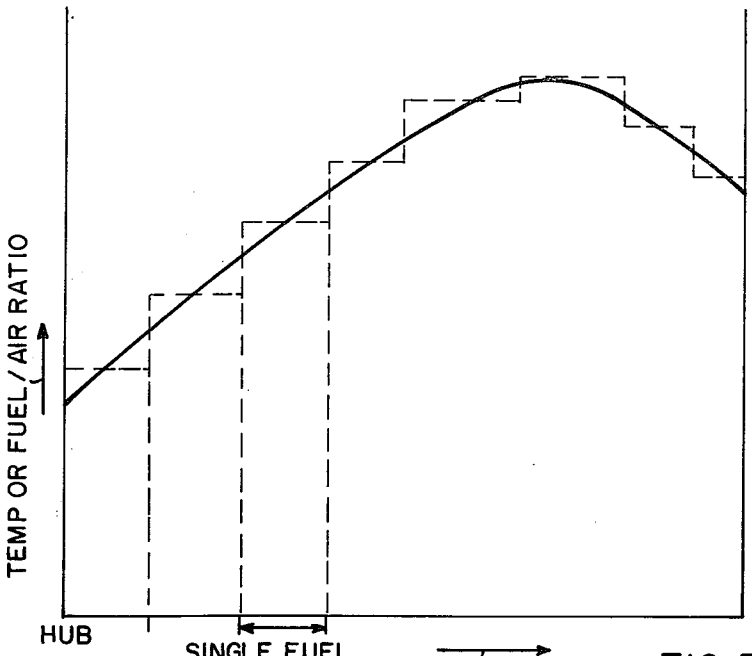

FIG. 2 shows an example of a desired temperature profile for a rotating turbine blade 16. The radially inner-most portion of the blade 16 needs to be coolest as it is the most highly stressed. The graph shown in FIG. 3 represents a part of the fuel-air ratio and hot motive fluid temperatures. The abscissa represents the blade length and the step-like graduation along the curve represent the number of fuel-air elements 22 and 27. A larger number of fuel air elements 22 and 27, may be desired for servicing the higher temperature regions of the catalytic combustor element 30, and fewer fuel-elements, 22 and 27, may be desired for supplying the outer periphery of the catalytic combustor element 30.

From the foregoing description it will be apparent that the invention provides the catalytic combustor having a very regulatable temperature profile of its hot motive fluid output. Although this invention has been described with one embodiment in connection with a gas turbine power plant, it should be understood that the invention is by no means limited to the disclosed embodiment and modification can be made in the disclosed structure without changing its fundamental principles of operation.

We claim:

1. A combustor arrangement including:

a combustor shell having an upstream portion and a discharge end;

means for delivering fuel to said upstream end of said combustor shell said means including a plurality of fuel injector elements and means for controlling the flow of fuel therethrough;

means for delivering air to said upstream end of said combustor shell, said means including a plurality of air inductor elements and means for controlling the flow of air therethrough;

a catalytic member disposed within said shell intermediate said upstream portion and said discharge end;

a plurality of passageways providing confined fuel-air communication between each of said fuel injector elements and associated air inductor elements and said catalytic member, said passageways permitting delivery of various fuel-air mixtures to discrete portions of said catalytic member without intermixing thereof, the plurality of controllable fuel-air mixtures delivered to said catalytic member permitting a regulatable temperature output from each discrete portion thereof.

2. A combustor arrangement as recited in claim 1 wherein:

said means for controlling the flow of air includes individual valve means associated with each of said air inductor elements, and;

said means for controlling the flow of fuel includes individual valve means associated with each of said fuel injector elements and wherein each passageway confines the delivery of at least one air inductor element and at least one fuel injector element to a discrete portion of said catalytic element.

3. A combustor arrangement as recited in claim 2 wherein the means for controlling the flow of fuel to each of said fuel injector elements provides regulated flow to each element independently of the flow of fuel to any of the other fuel injector elements.

4. A combustor arrangement as recited in claim 3 wherein the means for controlling the flow of air to each of said air inductor elements provides regulated flow to each independently of the flow of air to any of the other air inductor elements, and said regulation in said air and fuel flow to said discrete portions of said catalytic member permits regulatable variation of combustion intensity thereacross, and wherein;

said regulatable variation of combustion intensity across said catalytic member permits a regulatable temperature profile at said discharge end.

* * * * *